US007148412B2

(12) United States Patent
Crane

(10) Patent No.: US 7,148,412 B2
(45) Date of Patent: Dec. 12, 2006

(54) DRUM-MOUNTED STRIKER-TYPE PERCUSSION ATTACHMENT

(76) Inventor: Peter Crane, 1541 Rowley Rd., Fabius, NY (US) 13063

( * ) Notice: Subject to any disclaimer, the term of this patent is extended or adjusted under 35 U.S.C. 154(b) by 0 days.

(21) Appl. No.: 10/794,970

(22) Filed: Mar. 5, 2004

(65) Prior Publication Data

US 2005/0211058 A1 Sep. 29, 2005

(51) Int. Cl.
*G10D 13/08* (2006.01)

(52) U.S. Cl. ..... 84/402

(58) Field of Classification Search ..... 84/402–410, 84/422.4

See application file for complete search history.

(56) References Cited

U.S. PATENT DOCUMENTS 398,176 A 2/1889 Oerlein
706,230 A * 8/1902 Fuller ..... 84/402
4,028,984 A 6/1977 Sanchez ..... 84/422 R
5,503,056 A 4/1996 Evans ..... 84/422.4
5,684,258 A * 11/1997 Liao ..... 84/421
6,664,457 B1 12/2003 King ..... 84/402

* cited by examiner

*Primary Examiner*—Kimberly Lockett
(74) *Attorney, Agent, or Firm*—Bernhard P. Molldrem, Jr.

(57) ABSTRACT

A percussion attachment mounts onto the rim of an African hand drum, e.g., Jembe, so that the percussionist can play both the drum and the percussion device without having to pick up a drumstick or striker. The percussion attachment has a brace and a striker. The brace has transverse curved bar that rests rest atop the annular flange formed by the crown ring of the drum. Uprights, i.e., vertical legs affixed to the curved bar extend downward so a foot portion rests against the drum. A transverse pivot member is supported on the uprights above the curved bar at a position above the rim of the drum. A cowbell or other percussion device is supported on the brace. An elongated striker pivots on pivot member, with a handle and a striker tip. The tip moves in a vertical arc so that it can hit the cowbell when the percussionist slaps the striker handle. A spring can bias the striker to a neutral position. There can be more than one striker, and more than one percussion device.

9 Claims, 2 Drawing Sheets

DRUM-MOUNTED STRIKER-TYPE PERCUSSION ATTACHMENT

BACKGROUND OF THE INVENTION

This invention relates to musical instruments, in particular to percussion instruments, and is more particularly directed to a percussion attachment that can be mounted on a hand-struck percussion instrument, such as a Jembe, Conga, Dunin, Bougarabou or other hand drum.

African hand drums can produce a variety of sounds at various pitches, and have become popular for various musical effects. For that reason, it has been desired to increase the range of sounds that can be produced to broaden the musical effect of the drum. It is often desired for the percussionist to employ other struck percussion devices to produce other sounds. These can include cowbells, other bells, chimes or metal bars, wood blocks, claves, or plastic devices. By using an auxiliary percussion device or devices, the drummer can increase the effective sounds from a traditional gun-go-pa sound to include more metallic or brighter sounds, including dik, din, dang, dong, tik, kack, tock, gog, or the like. However, these devices such as bells, blocks, claves, or other struck percussion devices have to be played with a striker such as a drumstick or beater, so playing them requires the drummer to pick up the striker whereas the hand drum requires playing with the bare hand. Consequently, music for both hand drum and bells or blocks generally requires a second drummer to play the bells and blocks.

OBJECTS AND SUMMARY OF THE INVENTION

Accordingly, it is an object of this invention to provide an auxiliary device to be used with a hand drum that permits the drummer to augment his or her playing with a striker-played percussion device such as a bell, chime, block, etc.

It is another object to provide a percussion attachment that can be mounted onto a hand drum so that the associated percussion device can be played by slapping a handle portion of the striker.

It is another object to provide a percussion attachment that can be easily mounted on an existing hand drum or other drum without special hardware and without driving mounting screws into the body of the drum.

In accordance with an aspect of the present invention, a drum-mounted hand-slap striker-type percussion attachment mounts onto a drum of the type having a bowl portion, a head mounted across an open rim of the bowl portion, and head attachment means forming an annular flange around the bowl portion below its rim. In a typical African hand drum, the flange is formed by the crown ring and flesh ring around which the skin or head passes. The percussion attachment has a brace for mounting onto a side of the drum bowl portion. A transverse curved member rests upon the annular flange. An upright portion, i.e., at least one vertical leg, is affixed to the curved member and a portion of the upright portion extends downward to a foot portion that rests against a side of the drum. A transverse pivot member is supported above the curved portion at a position above the rim of the drum bowl portion. A support rod or bracket on the brace supports a cowbell, a chime, a wood block, or perhaps more than one percussion device at a position radially distal from said drum. An elongated striker, e.g., a rod or stick, is pivotally supported on the transverse pivot member. A handle portion is formed at a proximal end of the striker and a striker tip is formed at the distal end. The striker is movable about its pivot so that the striker tip is movable between a neutral position and a striking position contacting a surface of said percussion device. A pivot journal formed between the tip and the handle portion is pivotally journalled on the transverse pivot member of the brace; and a return mechanism, such as a return spring, biases the striker to its neutral position.

In one preferred embodiment, the brace is formed of a pair of vertical uprights or leg members each affixed to the curved member at laterally spaced locations, and a crossbar at an upper end of the uprights that forms the transverse pivot member. In some embodiments, the there can be a first striker and a second striker that are pivotally mounted side by side on the crossbar. There may also be a second percussion device supported on the brace and positioned to be struck with a striker tip of said second striker. In some possible embodiments, the second percussion device may be located below the striker, so that slapping the striker results in a first sound when the striker hits the upper percussion device, and then a second sound when the striker tip drops to the second percussion device.

The striker may be a rigid member in some embodiments, or may include a resilient flexible portion between the pivot journal and the striker tip, so that the striker is resiliently articulated.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENTS

Figure 1:
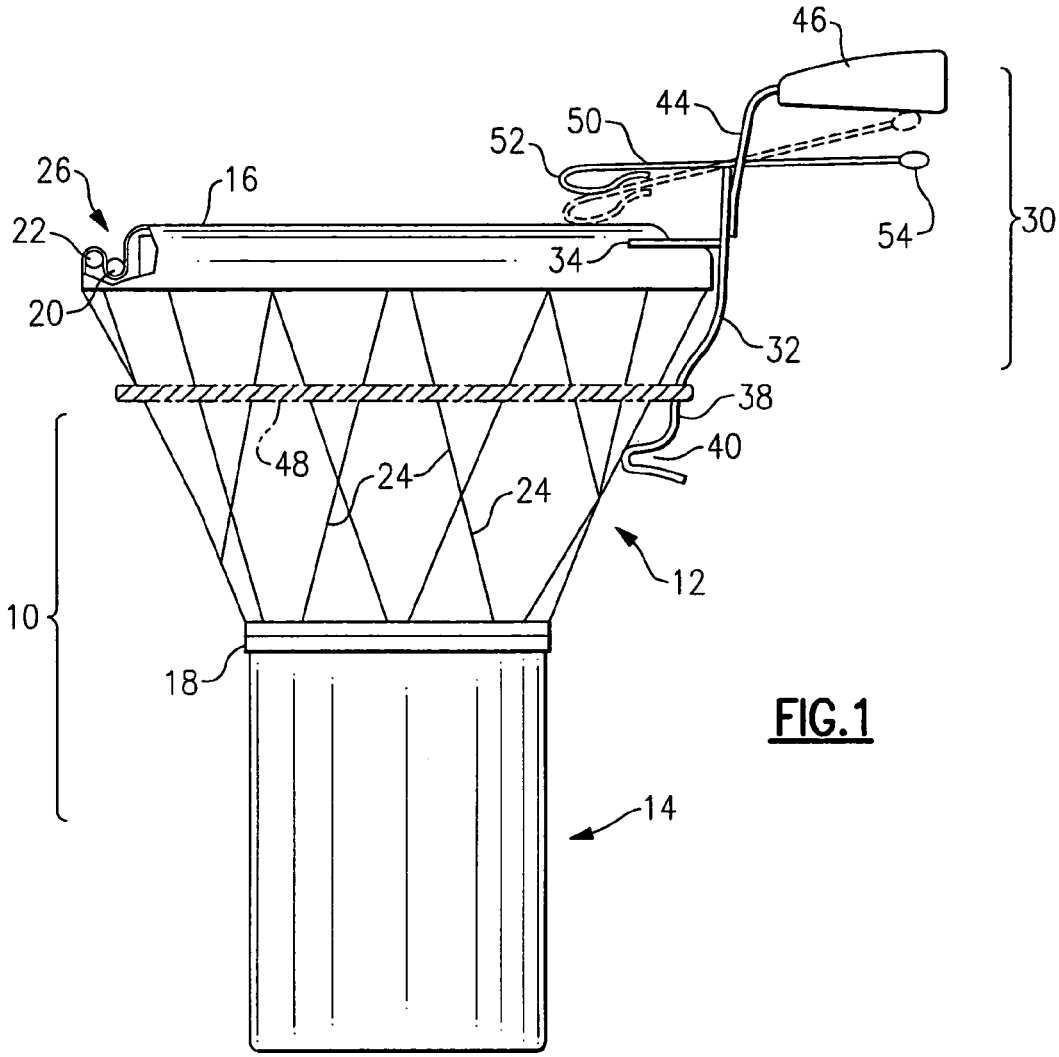
FIG. 1 is a side elevation of an African hand drum on which is mounted a percussion attachment according to an embodiment of this invention.

With reference to the Drawing, FIG. 1 depicts a typical African hand drum, in this embodiment a Jembe (sometimes spelled Djembe) 10, classically formed with a drum body consisting of an upper bowl portion 12 and a lower leg portion 14. The bowl portion has an open top covered by a head or skin 16, usually made of goat hide. A base ring 18 is located at the base of the bowl portion 12, while a flesh ring 20 and crown ring 22 are positioned at an upper part of the bowl portion just below its rim. The head passes around the flesh ring 20 and the crown ring 22 bears down on this to place tension on the drum head and control pitch. There are so-called verticals 24, i.e., cords or lines, that tie the crown ring 22 to the base ring 24 to generate tension, and these are typically tied together in a diamond pattern which can be adjusted to change the pitch of the instrument. The flesh ring 20 and crown ring 22, together with the edge of the drum head or skin 16 that passes over them, form an annular flange 26 that encircles the drum body just below the rim of the drum portion.

Figure 2:
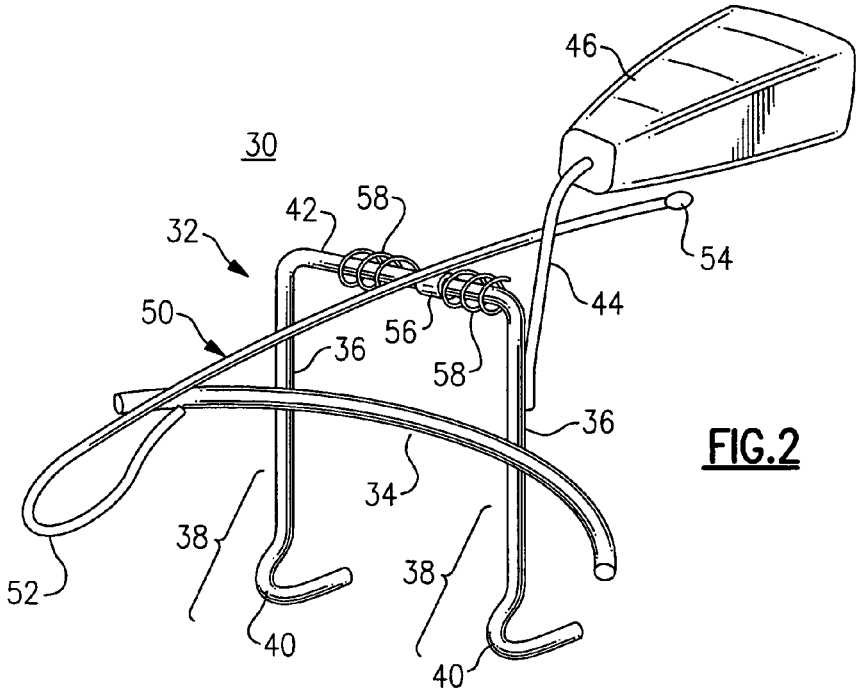
FIG. 2 is a perspective view of the percussion attachment of this embodiment.

A percussion attachment 30 according to one embodiment of this invention is shown in FIG. 1 and FIG. 2. This attachment is constructed of brace 32, which here has an arcuate bar or rod 34 that is situated transversely, i.e., horizontally, and seats upon the upper side of the annular flange 26 of the drum. The brace has at least one vertical member, and here there are a pair of vertical legs or uprights 36, 36 which are affixed to the arcuate bar 34 at spaced locations. Each leg 36 has a lower portion 38 that reaches below the flange 26 so as to extend down along the bowl portion of the drum, and a foot portion 40 that contacts the outer side of the drum body. A transverse bar 42 extends laterally between tops of the two uprights 36, 36 and serves as a pivot member. As shown in FIG. 1, a strap or cinch 48 is tied around the bowl portion 12 of the drum and over the lower portions 38 of the uprights to hold the brace 42 snugly onto the drum 10.

A support 44 extends up and outwards from one of the uprights 36, and a cow bell 46 is mounted upon this support 44. The cow bell is one of any number of struck percussion devices that could be mounted here, with some other percussion devices including chimes, blocks, and claves, to name a few. These devices may be metal, wood, or a synthetic material (plastic).

A striker 50 is pivotally mounted upon the transverse bar 42. Here the striker 50 is an elongated member with a handle portion 52 at its proximal end, i.e., positioned over the drum head, and a striker tip 54 at its distal end, i.e., positioned to strike a suitable surface of the bell 46. The handle portion 52 is here in the form of a loop, but other handle types may be used. A pivot journal 56 is formed on the striker between the handle 52 and the tip 54, and is jounalled on the transverse crossbar 42 so that the striker tip 54 can move in a vertical arc between a lower neutral position (solid in FIG. 1) away from the cow bell 46 and an upper strike position (dash lines in FIG. 1) in which the tip strikes the bell. A torsion spring 58 is present in this embodiment on the crossbar 46 as a means for biasing the striker 50 back towards its neutral position. In some embodiments, other means could be employed, and gravitation alone may be sufficient in some embodiments.

As illustrated, the attachment is positioned with the arcuate bar 34 resting on the flange 26 (formed by the rings 20, 22), and with the feet 40 against the side of the drum body, and the strap or cinch 48 holding the brace in place. This places the handle 52 of the striker a short distance above one edge of the drum head 16 near the rim. The percussionist can play the drum in the normal fashion by striking the head with his or her hands, and then when required for the desired sound, he or she can slap the striker handle 52 to play the cow bell 46 (or other percussion device). Slapping the handle 52 moves the striker tip 54 quickly up to hit the cow bell 46, and then the tip 54 drops back to its neutral position.

Figure 3:
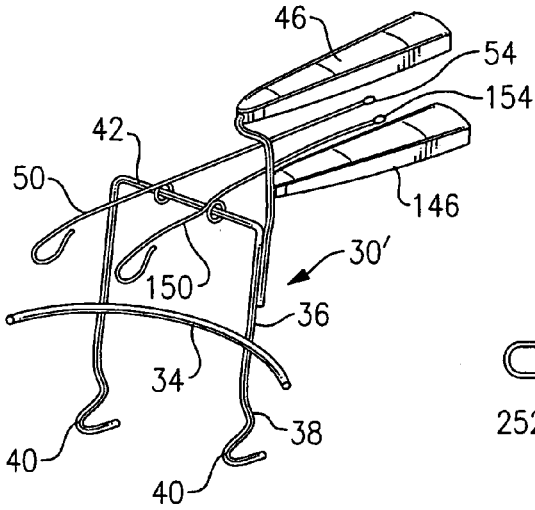
FIG. 3 is a perspective view of the percussion attachment of a second embodiment.

FIG. 3 illustrates one of many possible alternative embodiments, and the same reference numbers are used here as in FIGS. 1 and 2 to identify similar elements. Here, in addition to the striker 50 and the bell 46, the attachment 30' has a second striker 150 pivotally mounted on the crossbar 42 to one side of the first striker 50, and there is a second cow bell 146 (or other percussion device) mounted on a second support 144. The second bell 146 can be either above or below the strikers 50 and 150. The second striker 150 has a handle 152 and a striker tip 154. This permits two devices with different sounds or different pitches to be played in the same manner as in the single-bell attachment of the first embodiment. Where the second bell 146 is positioned below the strikers, then the first striker 50 may be used to play the first bell 26 only, and the second striker 150 may be positioned to play the first bell 46 on the upstroke of the tip 154 and then the second bell 146 on the return or downstroke before the striker 150 returns to a neutral position.

Figure 4:
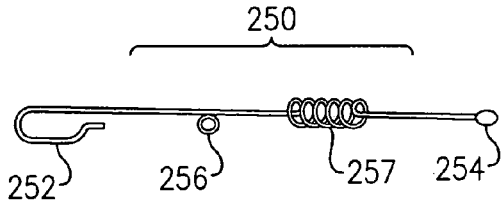
FIG. 4 is a side view of a resilient articulated striker which may be employed in embodiments of the invention.

FIG. 4 illustrates an articulated striker device 250 which may be used as an alternative to a rigid striker 50 or 150 in these embodiments. As shown, the striker device has a handle 252 at a proximal end, a striker tip 254 at a distal end, a pivot journal 256 between the handle and the tip, and a flexible resilient articulation 257 situated between the pivot journal 256 and the tip 254. This may be a coil spring of suitable stiffness. When the drum player strikes the handle 252, the spring absorbs the impact, and then delivers the stored energy upon impact of the striker tip with the bell.

Figure 5:
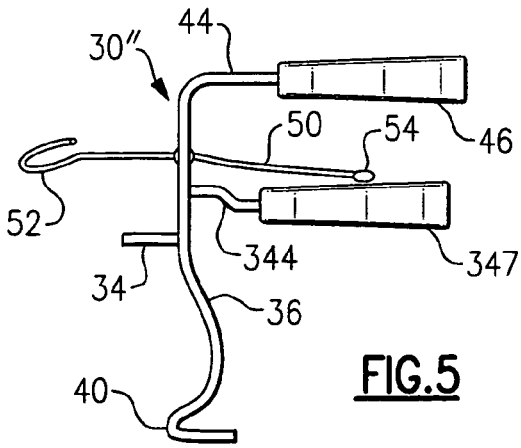
FIG. 5 is a side view of another embodiment of this invention.

FIG. 5 illustrates another embodiment 30" with the single striker 50, and with one bell 46 mounted on the support 44 so the bell is above the striker tip 54, and a second bell 346 on a second bell support 344 so the bell 346 is positioned below the striker tip. When the player slaps the handle 52, the striker tip first strikes the bell 46, and then returns against the bottom bell 346, so that one slap produces two successive notes, such as "dang"-"din". In this embodiment, the spring articulated striker 250 may be used to advantage, so that the tip 254 can rest just above the bell 346 rather than lying against it.

Of course, many different styles of braces or brackets, and other strikers may be employed without setting aside the main principles of this invention, and the percussion attachment can be used with a wide variety of drums in addition to the Jembe drum that is illustrated here.

While the invention has been described in detail with respect to one preferred embodiment, it should be recognized that there are many alternative embodiments that would become apparent to persons of skill in the art. Many modifications and variations are possible which would not depart from the scope and spirit of this invention, as defined in the appended claims.

I claim:

1. A drum-mounted hand-slap striker-type percussion attachment for mounting onto a drum of the type having a bowl portion, a head mounted across an open rim of the bowl portion, and head attachment means forming an annular flange around the bowl portion below the rim of the drum bowl portion; the attachment comprising:

a brace for mounting onto a side of the drum bowl portion, including a transverse arcuate member extending in a horizontal curve and adapted to rest atop said annular flange; at least one vertical leg affixed to the curved member with a portion extending downward to a foot portion that rests against a side of the bowl portion of said drum; a transverse pivot member supported above the arcuate member at a position above the rim of the drum bowl portion; and means supporting at least one device at a position radially distal from said drum; and an elongated striker pivotally journalled on said transverse pivot member, having a handle portion at a proximal end thereof and a striker tip at a distal end thereof; said striker tip being movable with the pivotal action of the striker between a neutral position and a striking position contacting a surface of said percussion device; a pivot journal situated between said tip and said handle portion that is pivotally journalled on said transverse pivot member; and return means biasing said striker to said neutral position.

2. The percussion attachment according to claim 1 wherein said drum is a jembe, and said rim is formed by a crown ring of said jembe.

3. The percussion attachment according to claim 1 wherein said percussion device is a member of the group that consists of a block, a dave, a chime, and a cowbell.

4. A drum-mounted hand-slap striker-type percussion attachment for mourning onto a drum of the type having a bowl portion, a head mounted across an open rim of the bowl portion, and head attachment means forming an annular flange around the bowl portion below the rim of the drum bowl portion; the attachment comprising;

a brace for mounting onto a side of the drum bowl portion, including a transverse curved member adapted to rest atop said annular flange; at least one vertical leg affixed to the curved member with a portion extending downward to a foot portion that rests against a side of the drum; a transverse pivot member supported above the curved member at a position above the rim of the drum bowl portion; and means supporting at least one percussion device at a position radially distal from said drum; and an elongated striker pivotally supported on said transverse pivot member, having a handle portion at a proximal end thereof and a striker tip at a distal end thereof; said striker tip being movable with the pivotal action of the striker between a neutral position and a striking position contacting a surface of said percussion device; a pivot journal between said tip and said handle portion that is pivotally journalled on said transverse pivot member; and return means biasing said striker to said neutral position;

wherein said brace is formed of a pair of vertical leg members each affixed to said curved member at laterally spaced locations thereon, and a crossbar at an upper end of said legs forming said transverse pivot member.

5. The percussion attachment according to claim 4 wherein the first mentioned elongated striker device and a second striker are pivotally mounted in side by side positions on said crossbar.

6. The percussion attachment according to claim 5 wherein there is a second percussion device supported on said brace and positioned to be struck with a striker tip of said second striker.

7. The percussion attachment according to claim 1 wherein said striker includes a resilient flexible member between said pivot journal and said striker tip, so that the distal portion of said striker is resiliently articulated.

8. A drum-mounted hand-slap striker-type percussion attachment for mounting onto a drum of the type having a bowl portion, a head mounted across an open rim of the bowl portion, and head attachment means forming an annular flange around the bowl portion below the rim of the drum bowl portion; the attachment comprising:

a brace for mounting onto a side of the drum bowl portion, including a transverse curved member adapted to rest atop said annular flange; at least one vertical leg affixed to the curved member with portion extending downward to foot portion that rests against a side of the drum; a transverse pivot member supported above the curved member at a position above the rim of the drum bowl portion; and means supporting at least one percussion device at a position radially distal from said drum; and an elongated striker pivotally supported on said transverse pivot member, having a handle portion at a proximal end thereof and a striker tip at a distal end thereof; said striker tip being movable with the pivotal action of the striker between a neutral position and a striking position contacting a surface of said percussion device; a pivot journal between said tip and said handle portion that is pivotally journalled on said transverse pivot member; and return means biasing said striker to said neutral position;

wherein there is a second percussion device supported on said brace and positioned below said striker.

9. The percussion attachment according to claim 1 wherein said return means includes a torsion spring.

* * * * *

UNITED STATES PATENT AND TRADEMARK OFFICE

CERTIFICATE OF CORRECTION

PATENT NO. : 7,148,412 B2
APPLICATION NO. : 10/794970
DATED : December 12, 2006
INVENTOR(S) : Peter Crane It is certified that error appears in the above-identified patent and that said Letters Patent is hereby corrected as shown below:

| | |
|---|---|
| Col. 5, Claim 3, line 3: | "dave" should read --clave-- |
| Col. 5, Claim 4, line 5: | "mourning" should read -- mounting -- |
| Col. 6, Claim 8, line 15: | –insert the word --a -- between "to" and "foot" |

Signed and Sealed this

Thirteenth Day of March, 2007

JON W. DUDAS
*Director of the United States Patent and Trademark Office*